US008113877B2

(12) United States Patent
Chang

(10) Patent No.: US 8,113,877 B2
(45) Date of Patent: Feb. 14, 2012

(54) CONNECTOR FOR CONNECTING EXTERNAL ANTENNA

(76) Inventor: Nai-Chien Chang, Sanchong (TW)

( * ) Notice: Subject to any disclaimer, the term of this patent is extended or adjusted under 35 U.S.C. 154(b) by 39 days.

(21) Appl. No.: 12/873,210

(22) Filed: Aug. 31, 2010

(65) Prior Publication Data

US 2011/0111625 A1 May 12, 2011

(30) Foreign Application Priority Data

Nov. 12, 2009 (TW) ..... 98221047 U

(51) Int. Cl.
*H01R 9/05* (2006.01)

(52) U.S. Cl. ..... 439/578

(58) Field of Classification Search ..... 200/577–585, 200/607.24, 916, 939
See application file for complete search history.

(56) References Cited

U.S. PATENT DOCUMENTS

| | | | | |
|---|---|---|---|---|
| 6,234,834 | B1 * | 5/2001 | Tsai et al. | 439/541.5 |
| 6,368,150 | B1 * | 4/2002 | Zheng et al. | 439/541.5 |
| 6,625,016 | B2 * | 9/2003 | Glusing et al. | 361/679.41 |
| 2010/0062618 | A1 * | 3/2010 | Lai et al. | 439/63 |
| 2010/0203764 | A1 * | 8/2010 | Chang | 439/625 |

* cited by examiner

*Primary Examiner* — Edwin A. Leon
(74) *Attorney, Agent, or Firm* — Chun Ming Shih; HDLS IPR Services

(57) ABSTRACT

A connector for connecting an external antenna includes a base, an electric connector and a joint. The base has a port and a containing space. The electric connector is installed in the port. The joint is installed in the containing space and extended and exposed from the opening. The joint includes a connecting pillar, a connecting portion disposed on the connecting pillar, an insulation lining contained in the connecting pillar, a signal feed-in plughole formed at the center of the insulation lining, and a signal feed-in pin installed at an end of the signal feed-in plughole and extended out from an end of the joint. After the joint is connected to a cable, the connector can be connected externally to an antenna.

10 Claims, 7 Drawing Sheets

CONNECTOR FOR CONNECTING EXTERNAL ANTENNA

FIELD OF THE INVENTION

The present invention generally relates to a connector, in particular to a cable connector capable of connecting an external antenna.

BACKGROUND OF THE INVENTION

As Internet becomes increasingly popular, most communication equipments or electronic products come with a built-in antenna or a connector for connecting an external antenna, so that users can log on the Internet via the antenna to browse the Internet, upload data, download data, or send/receive short messages and mails.

At present, a notebook computer is generally used by users to log on a wireless network to browse the Internet, upload data, download data or send and receive mails. Since the notebook computer usually comes with a built-in antenna installed at the periphery of an LCD panel to provide a good transmitting and receiving capability to the notebook computer, so that the antenna has an excellent receiving directivity.

As is well know, it is relatively troublesome to manufacture a display device with a built-in antenna, because the space for installing a number of antennas in the display device must be taken into account. If the length of the antenna is too long, the original reserved space will be insufficient to install the antenna, so that it is necessary to shorten the antenna. However, the receiving and transmitting effects of the shortened antenna will become poor.

SUMMARY OF THE INVENTION

Therefore, it is a primary objective of the present invention to overcome the shortcomings of the prior art by providing a connector for connecting an external antenna, so that users can connect the antenna to a joint of a cable.

To achieve the aforementioned objective, the present invention provides a connector for connecting an external antenna, and the connector comprises: a base, having a port and a T-shaped containing space, and the T-shaped containing space having a U-shaped opening formed at the front of the T-shaped containing space, and two symmetrical penetrating holes formed on both sides of the U-shaped opening respectively; an electric connector, connected into the port; and a joint, having a connecting pillar disposed across the U-shape opening, a connecting portion formed at a front section of the connecting pillar, a latch plate disposed at a rear section of the connecting pillar, and a through hole formed on the latch plate and corresponding to the penetrating hole; an insulation lining contained in the connecting pillar, and having a signal feed-in plughole formed at the center of the insulation lining; and a signal feed-in pin installed at an end of the signal feed-in plughole and extended out from an end of the joint, wherein the latch plate and the signal feed-in pin of the joint are installed in the containing space, and the through hole corresponds to the penetrating hole.

DESCRIPTION OF THE PREFERRED EMBODIMENTS

The technical characteristics and contents of the present invention will become apparent with the following detailed description accompanied with related drawings, and it is noteworthy to point out that the drawings are provided for the reference and illustration purposes only, but not intended for limiting the scope of the invention.

Figure 1:
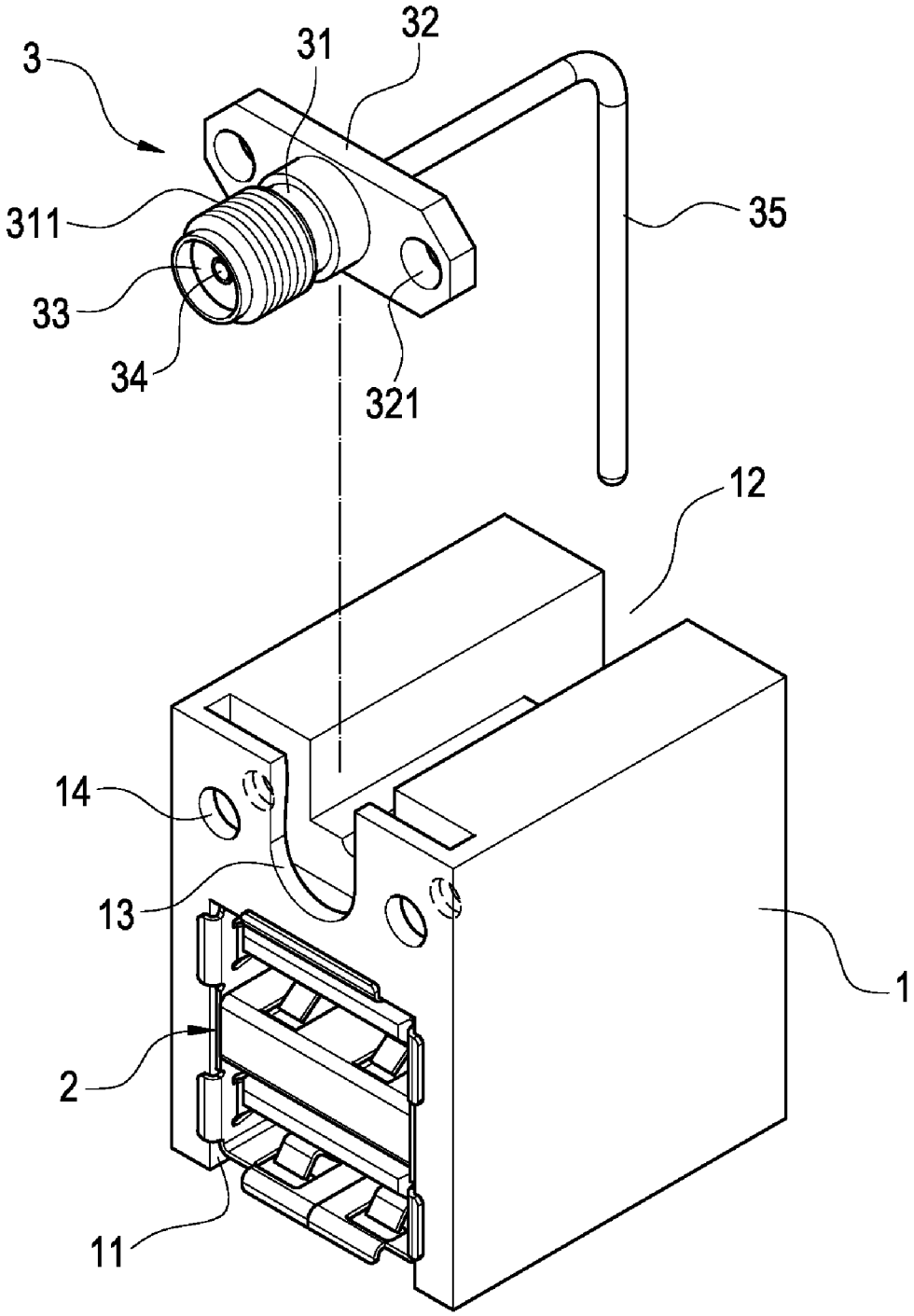
FIG. 1 is an exploded view of a connector of the present invention.

With reference to FIG. 1 for an exploded view of a connector of the present invention, the connector for connecting an external antenna comprises a base 1, an electric connector 2 and a joint 3.

The base 1 includes a port 11 and a T-shape containing space 12, and the port 11 is provided for installing the electric connector 2. The T-shape containing space 12 is provided for installing the cable joint 3. A U-shape opening 13 is formed at a front end of the T-shape containing space 12, and two symmetrical penetrating holes 14 are formed on both sides of the U-shape opening 13 respectively.

The electric connector 2 is connected into the port 11. The electric connector can be formed by any one of the HDMI, DisplayPort, USB, and e-SATA connectors or stacking or combining any two different or same electric connectors selected from the HDMI, DisplayPort, USB, and e-SATA connectors.

The joint 3 includes a connecting pillar 31 disposed across the U-shape opening 13, a threaded connecting portion 311 disposed at a front end of the connecting pillar 31 and connectable to a cable (not shown in the figure), and a latch plate 32 installed at an end of the connecting pillar 31 and having a through hole 321 corresponding to the penetrating hole 14. In addition, the connecting pillar includes an insulation lining 33 therein, a signal feed-in plughole 34 formed at the center of the insulation lining 33, and a signal feed-in pin 35 installed at an end of the signal feed-in plughole 34 and extended out from an end of the joint 3. When the joint 3 is installed in the containing space 12, the latch plate 32 and the signal feed-in pin 35 of the joint 3 are installed in the containing space 12, and the through hole 321 corresponds to the penetrating hole 11. In FIG. 1, the joint 3 is a SMA male joint or a SMA female joint.

Figure 2:
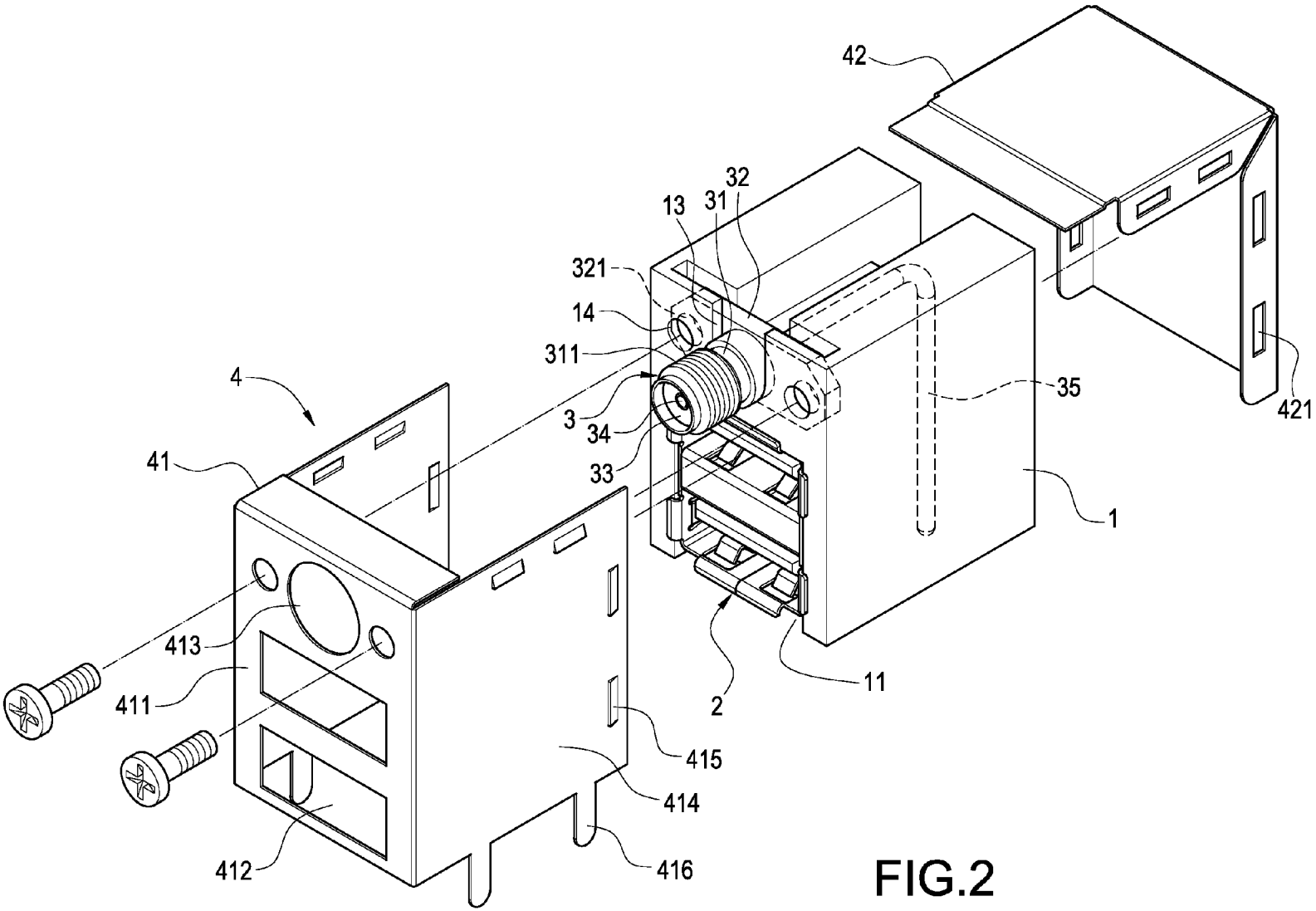
FIG. 2 is another exploded view of a connector of the present invention.
Figure 3:
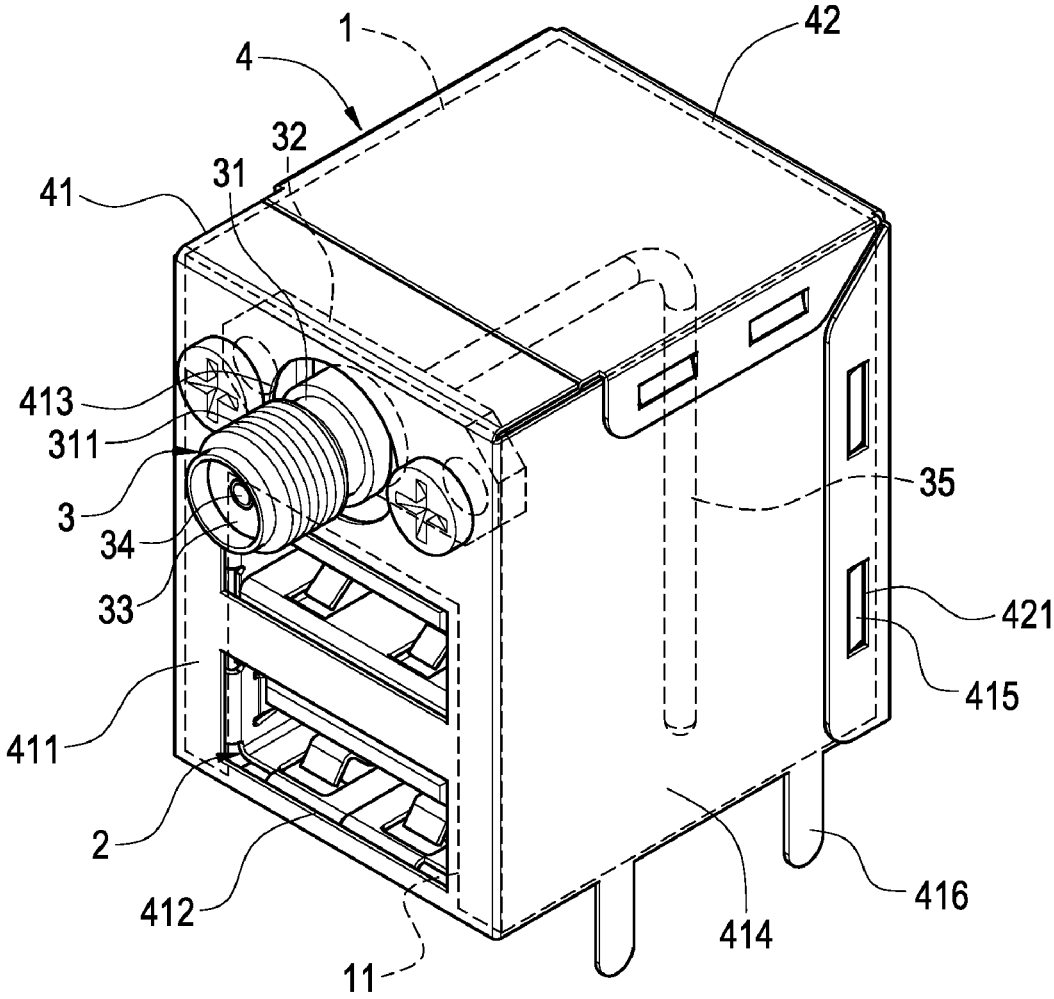
FIG. 3 is a perspective view of a connector of the present invention.

With reference to FIGS. 2 and 3 for another exploded view and a perspective view of a connector of the present invention respectively, the connector for connecting an external antenna comprises a base 1, an electric connector 2 and a joint 3, wherein the base 1 includes a metal housing 4 installed onto the exterior of the base 1, and the metal housing 4 includes a front casing 41 and a rear casing 42, and the front panel 411 of the front casing 41 includes a plurality of slots 412 and penetrating holes 413 provided for exposing the electric connector 2 and the joint 3.

After the front casing 41 is installed at the front end of the base 1, the rear casing 42 is installed at the rear end of the base 1, and snap holes 421 formed on lateral sides of the rear casing 42 are snapped onto protrusions 415 formed on two side panels 414 of the front casing 41 respectively, such that the front casing 41 and the rear casing 42 can cover the base 1 securely, and the metal housing 4 also can prevent the electric connector 2 and the joint 3 from being affected by electromagnetic interference. In addition, fixing legs 416 are formed at the bottom of the two side panels 414 of the front casing 41, such that the connector can be fixed to a main board of an electronic device (not shown in the figure).

Figure 4:
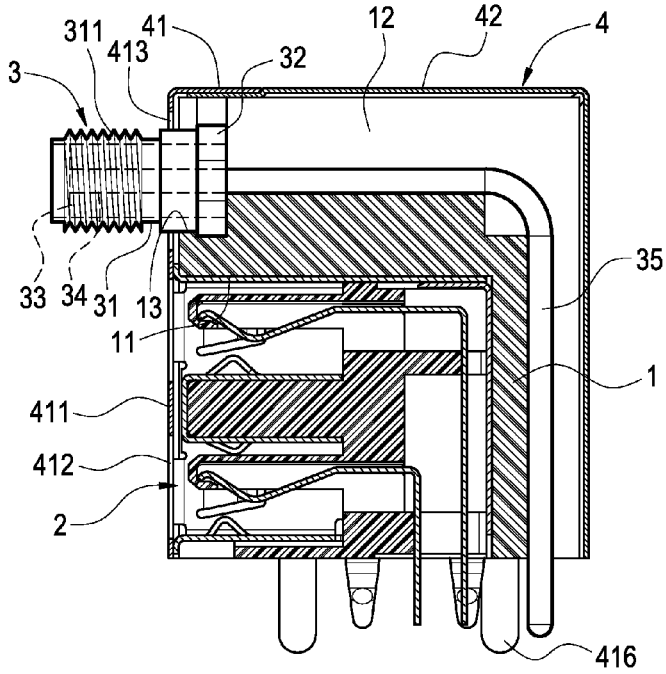
FIG. 4 is a cross-sectional view of a connector of the present invention.
Figure 5:
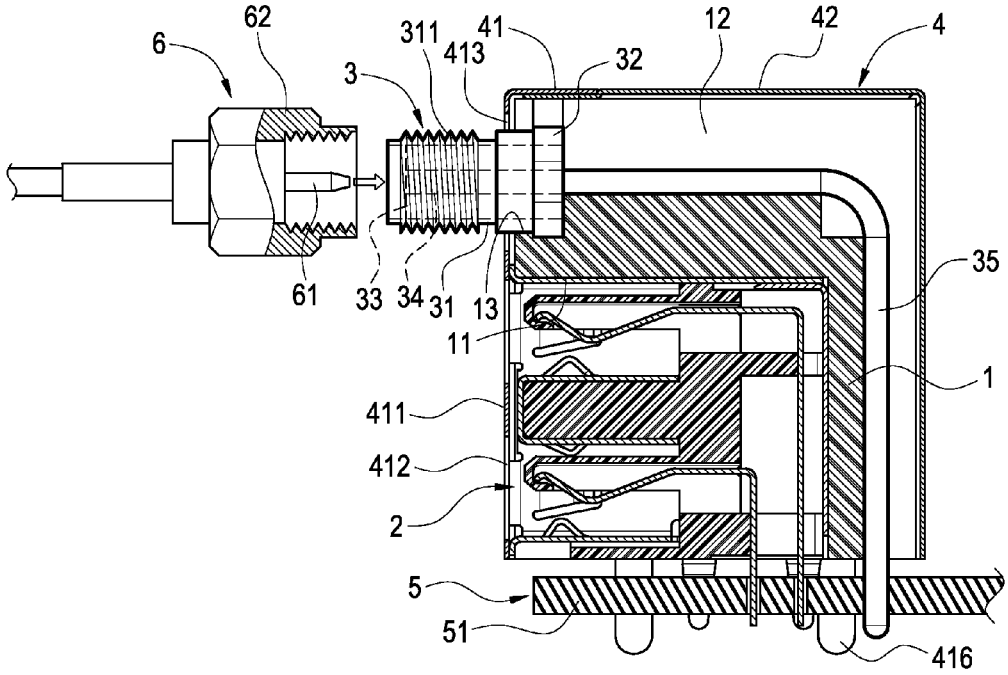
FIG. 5 is a cross-sectional view showing a connector connected to a main board of an electronic device in accordance with the present invention.

With reference to FIGS. 4 and 5 for cross-sectional views of a connector of the present invention and the connector connected to a main board of an electronic device respectively, the connector of the present invention is electrically connected to the main board 51 of the electronic device 5, and the electric connector 2 can be connected to a HDMI, DisplayPort, USB, or e-SATA transmission cable.

After a signal feed-in pin 61 in a cable plug 6 of the antenna is inserted into the signal feed-in plughole 34, a nut 62 is secured onto the connecting portion 311 of the connecting pillar 31, such that the cable plug 6 and the joint 3 can be connected securely and provided for receiving signals.

Figure 6:
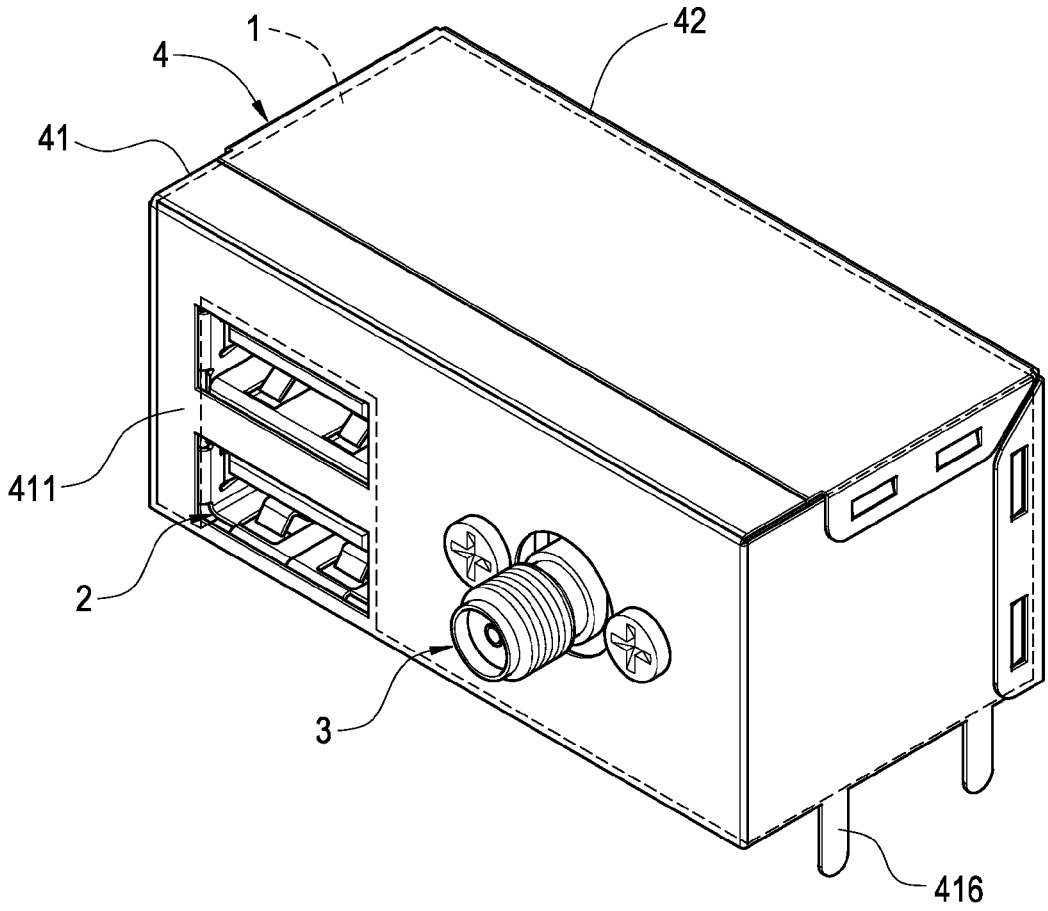
FIG. 6 is a schematic view of another preferred embodiment of the present invention.

With reference to FIG. 6 for a schematic view of another preferred embodiment of the present invention, the electric connector 2 of this preferred embodiment is arranged adjacent to the cable joint 3 or stacked on top of the cable joint 3 to provide different options for the design of the connector.

Figure 7:
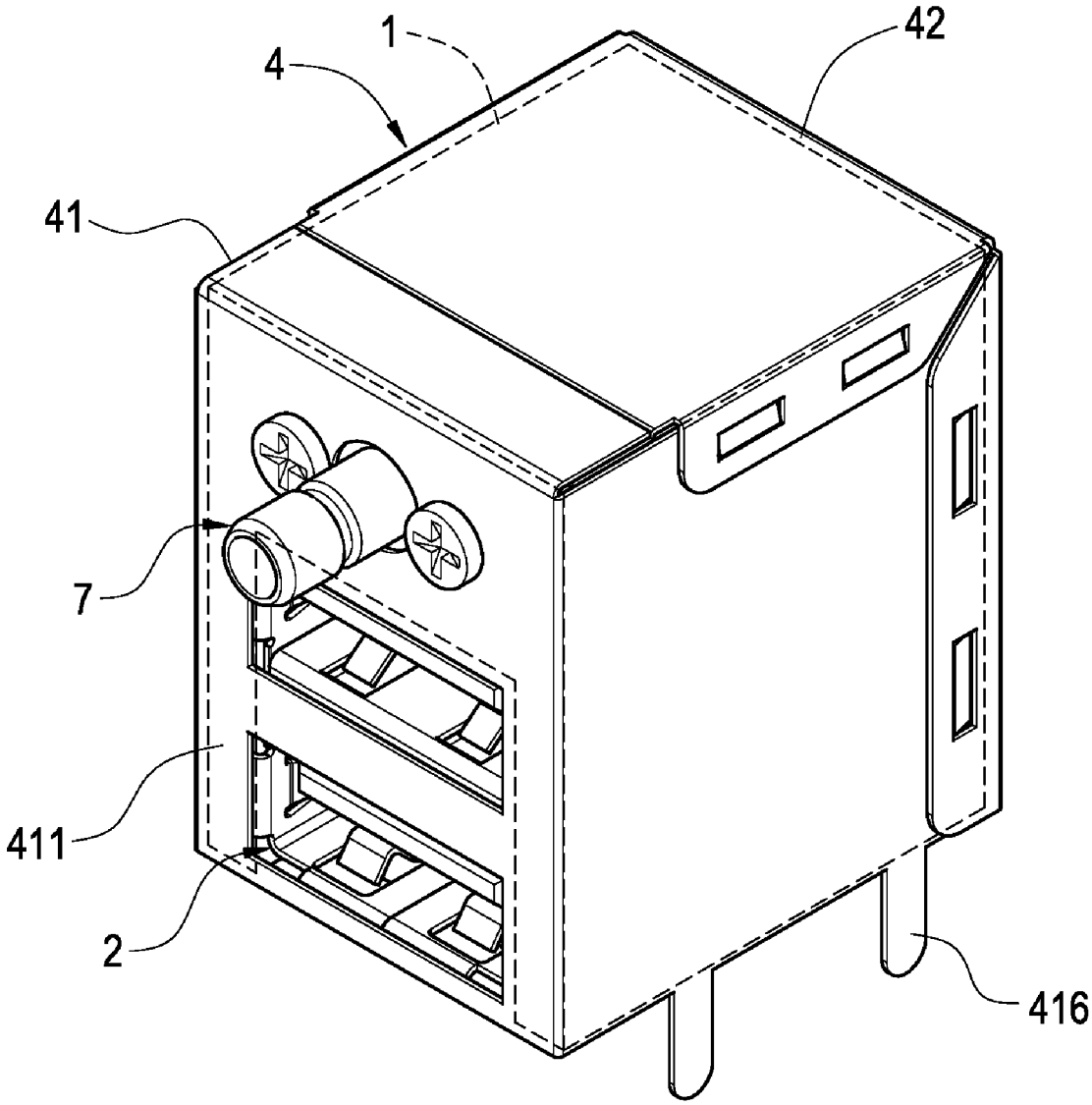
FIG. 7 is a schematic view of a further preferred embodiment of the present invention.

With reference to FIG. 7 for a schematic view of a further preferred embodiment of the present invention, the present invention also can adopt a SMB (male or female) joint 7 in addition to the SMA (male or female) joint 3.

Figure 8:
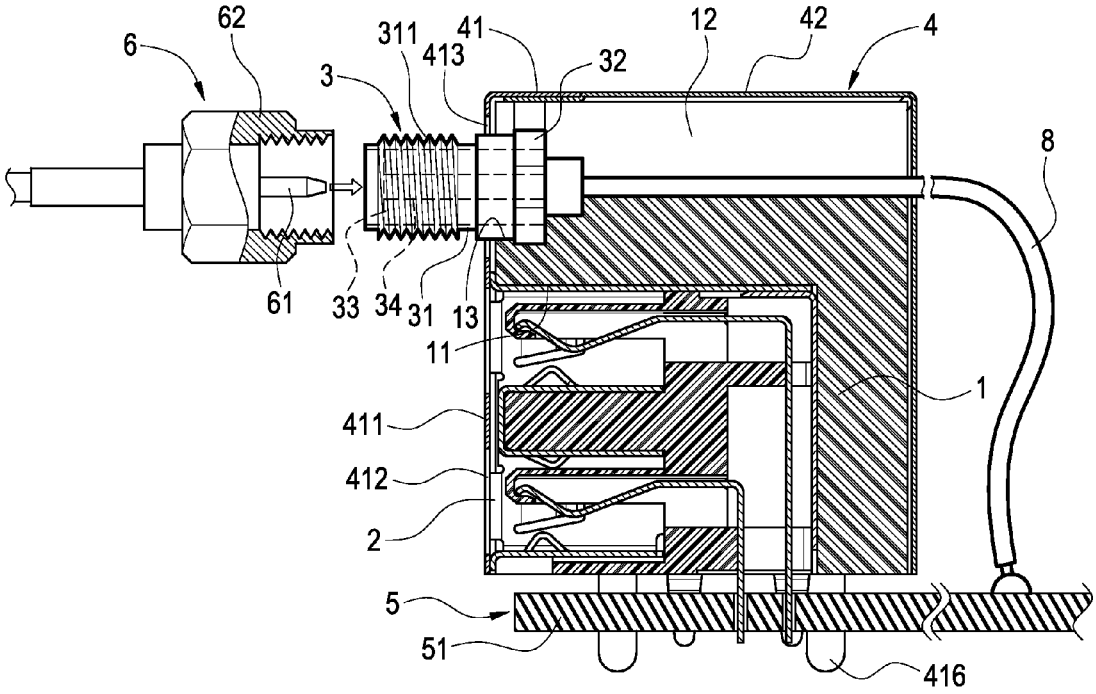
FIG. 8 is a schematic view of another further preferred embodiment of the present invention.

With reference to FIG. 8 for a further preferred embodiment of the present invention, after a SMA (male or female) joint 3 or a SMB (male or female) joint 7 is combined with the connector, a transmission cable 8 can be electrically connected to an output pin at an end of the SMA (male or female) joint 3 or the SMB (male or female) joint 7, and an end of the transmission cable 8 can be electrically connected to the main board 51 of the electronic device 5 and the cable plug 6 of the antenna installed at the front end of the SMA(male or female) joint 3 or the SMB (male or female) joint 7. After the antenna has received a signal to be transmitted through the cable plug 6 to the SMA (male or female) joint 3 or the SMB (male or female) joint 7, the signal is transmitted through the transmission cable 8 to the main board 51, and after the signal processed by the main board 51 is transmitted through the transmission cable 8 to the SMA (male or female) joint 3 or the SMB (male or female) joint 7, the signal is transmitted from the cable plug 6 to the antenna and then transmitted to the outside from the antenna.

While the invention has been described by means of specific embodiments, numerous modifications and variations could be made thereto by those skilled in the art without departing from the scope and spirit of the invention set forth in the claims.

What is claimed is:

1. A connector for connecting an external antenna, and being electrically coupled to a main board of an electronic device, and comprising:

a base, having a port and a containing space formed thereon, and an opening formed at a front end of the containing space;

an electric connector, connected into the port; and a joint, connected into the containing space, extended and exposed from the opening, and having a connecting pillar disposed thereon, and an insulation lining disposed in the connecting pillar, and a signal feed-in plughole formed at the center of the insulating lining, and a signal feed-in pin installed at an end of the signal feed-in plughole extended out from an end of the joint.

2. The connector for connecting an external antenna as recited in claim 1, wherein the containing space is T-shaped.

3. The connector for connecting an external antenna as recited in claim 2, wherein the opening is U-shaped.

4. The connector for connecting an external antenna as recited in claim 3, further comprising two symmetrical penetrating holes formed on both sides of the opening respectively.

5. The connector for connecting an external antenna as recited in claim 1, wherein the electric connector is formed by any one selected from the collection of HDMI, DisplayPort, USB, and e-SATA connectors, or combining any two different or same electric connectors selected from the collection of HDMI, DisplayPort, USB, and e-SATA connectors.

6. The connector for connecting an external antenna as recited in claim 1, wherein the connecting pillar includes a threaded connecting portion disposed at a front section of the connecting pillar, and a latch plate disposed at a rear section of the connecting pillar, and the latch plate includes a through hole corresponding to the penetrating hole.

7. The connector for connecting an external antenna as recited in claim 6, wherein the joint is a SMA joint or a SMB joint.

8. The connector for connecting an external antenna as recited in claim 1, further comprising a metal housing installed externally onto the base, and the metal housing including a front casing and a rear casing, and the front panel of the front casing having a plurality of slots and penetrating holes for exposing the electric connector and the joint.

9. The connector for connecting an external antenna as recited in claim 8, wherein the front casing is coupled to a front end of the base, and then the rear casing is coupled to a rear end of the base, and a snap hole formed on a lateral side of the rear casing is snapped on a protrusion formed separately on two side panels of the front casing, and the front casing and the rear casing are provided for covering the base securely, and a fixing leg is extended separately from the bottom of the two side panels of the front casing, and the fixing leg is provided for fixing the connector to the main board of the electronic device.

10. The connector for connecting an external antenna as recited in claim 1, wherein the joint includes an output pin disposed at an end of the joint and electrically coupled to a transmission cable, and an end of the transmission cable is electrically coupled to the main board of the electronic device.

* * * * *